United States Patent [19]

Rookard, Jr.

[11] 4,272,768

[45] Jun. 9, 1981

[54] MULTI-PURPOSE SURVIVAL CANTEEN

[76] Inventor: Johnnie P. Rookard, Jr., 1061-72nd Ave., Apt. 4, Oakland, Calif. 94621

[21] Appl. No.: 113,442

[22] Filed: Jan. 21, 1980

[51] Int. Cl.[3] ..... H01Q 15/18; B65D 1/04

[52] U.S. Cl. ..... 343/18 C; 215/6; 215/13 R

[58] Field of Search ..... 343/18 C; 215/6, 13 R

[56] References Cited

U.S. PATENT DOCUMENTS

| | | | |
|---|---|---|---|
| 3,019,457 | 2/1962 | Lowert | 343/18 C X |
| 3,126,544 | 3/1964 | Greatbatch, Jr. | 343/18 C |
| 3,276,017 | 9/1966 | Mullin | 343/18 C |

*Primary Examiner*—T. H. Tubbesing

*Attorney, Agent, or Firm*—Manfred M. Warren; Robert B. Chickering; Glen R. Grunewald

[57] ABSTRACT

A survival canteen is disclosed which has a substantially microwave transparent vessel for holding liquid. The vessel has internal microwave-reflective baffles which divide the vessel into chambers. Openings between the chambers allow damped fluid flow therebetween. The baffles are positioned to define at least one corner reflector so as to provide a highly reflective radar target.

7 Claims, 3 Drawing Figures

MULTI-PURPOSE SURVIVAL CANTEEN

BACKGROUND OF THE INVENTION

1. Field of Invention

The invention relates generally to canteens and related personally carried liquid containers and, more specifically, to marine survival equipment.

2. Description of Prior Art

The word "canteen" is normally used to describe a portable flask for carrying water or other liquids. The most familiar type of canteen is the cloth-jacketed metal flask issued to soldiers as a part of their mess kit. Plastic has found wise use in the construction of modern canteen vessels owing to its comparative advantages to metal in the areas of cost, thermal conductivity, and ease of manufacture. Canteens are usually carried by means of a strap, belt, or other personally worn affixing device.

A canteen, when completely filled with liquid, presents little problem to the carrying person. The full canteen responds to normal body movements in a predictable manner, very much like that exhibited by a solid object. When the contents of the canteen have been partially emptied, however, the body movements of the carrying person cause sloshing within the canteen. This sloshing sets up a complex set of forces on the canteen and results in motion similar to that exhibited by a compound pendulum. Unless the partially emptied canteen is tightly strapped to the person, it will exhibit the aforementioned erratic motion, which can be annoying or even physically irritating, depending upon how the canteen is worn.

In the field of marine survival equipment, many inventions have been disclosed which aid in the flotation, insulation, and location of a person who is overboard. Flotation devices include life jackets, life rings, and various types of inflatable air bladders. Since a person's survival time is drastically decreased when immersed in cold water, several devices have been disclosed to insulate the body to prevent heat loss. These devices include so-called survival suits, which are very similar to the neoprene suits worn by skin divers. There have also been many devices disclosed to aid in the location of a person who has been lost overboard. These devices include passive structures such as brightly colored apparel and signal mirrors for reflecting sunlight, as well as active devices, such as electric lights and portable radio transmitters.

Although the aforementioned survival devices can be quite effective, they are bulky, expensive, and serve no purpose other than safety. Because of these drawbacks, few sailors wear the aforementioned survival devices during their normal day-to-day duties. Since many man-overboard accidents have happened inadvertently during non-emergency work situations, persons such as the aforementioned sailors have been denied the benefit of survival equipment.

Marine radar is a highly effective tool in locating and tracking the position of targets having suitable microwave-reflective qualities. It has long been known that a so-called corner reflector, comprising three perpendicular intersecting planes of microwave-reflective material, such as metal, provides an excellent radar target. The geometry of the corner reflector causes any incident ray to be reflected in an exactly parallel direction. Corner reflectors have found wide use on buoys, boats, and other objects where safety depends on their effective detection by radar.

The canteens and various marine survival devices of the prior art are all distinguishable from the instant invention in that none discloses or even suggests the unique structure of a microwave-transparent canteen having internal microwave-reflective baffles which aid in maintaining its dynamic stability and which are configured so as to provide a highly efficient radar target.

SUMMARY OF THE INVENTION

An object of the present invention is to provide a multi-purpose survival canteen having the following features:

(a) a canteen which can be comfortably worn when partially full and which does not exhibit the undesirable dynamic characteristics caused by undamped sloshing of the liquid contents;

(b) a canteen which has suitable thermal insulation so as to enable the user to carry hot liquids, such as coffee, and to maintain the temperature of the liquid over a reasonable period of time;

(c) a canteen which will, when the user is overboard, provide means for increasing his flotation;

(d) a canteen which will, even when full, float itself so that it is not a burden to a swimming user and can provide protection against fatal hypothermia (death from body heat loss) by allowing the user to drink its heated contents periodically while awaiting rescue;

(e) a canteen which will provide a highly reflective radar target.

The present invention is a multi-purpose survival canteen having the form of a substantially microwave-transparent vessel for holding liquid. The vessel has a sealable mouth to enable the user to drink from the canteen. Internal microwave-reflective baffles are provided which divide the vessel into chambers. Openings between the chambers allow fluid to flow therebetween in a damped fashion. This prevents uncontrolled sloshing and results in stable, desirable dynamic characteristics even when the canteen is partially full. The baffles are positioned so as to define at least one corner reflector. This is accomplished by arranging at least three baffles so that they are perpendicular to each other and intersect at at least one point. The geometry of the corner reflector assures that an incident beam of microwave energy from a radar transmitter will be reflected in an exactly parallel path, thus assuring detection by the receiver. When the baffles are arranged as shown in the drawings, eight corner reflectors are provided.

Since it is desirable to have effective thermal insulation as well as increased flotation, the vessel of the instant invention can be surrounded by certain materials, such as closed-cell plastic foams which are reasonably transparent to microwave energy. These foams have very good thermal insulation properties and desirable flotation characteristics.

The present invention, by providing a comfortably worn, thermally insulated liquid container which has a number of important and effective life-saving features, greatly increases the probability that the canteen will be worn by sailors during their normal duties. Most of the survival devices in the prior art are seldom worn during non-emergency situations since they provide no immediate benefit to the user and often interfere with his movements and comfort. The instant invention can provide the user with a ready cup of hot coffee, which makes it desirable apart from its use as a life-saving device. All of the devices in the prior art, no matter how effective, are of no use if not worn by the user. Only one of the instant invention's many life-saving features is forfeited when the container is empty. The ingestion of heated liquids can be used to delay the onset of fatal hypothermia by partially compensating for body heat which has been lost to the surrounding water. When the container is empty, its flotation and radar-reflective characteristics are actually enhanced. The importance of radar as a means of locating a person in distress cannot be over-emphasized. At night or during conditions of reduced visibility, radar is far more effective than human eyesight. Although the canteen of the instant invention provides a relatively small surface area, the arrangement of the internal baffles into a corner reflector configuration assures the maximum possible reflection of incident microwave energy. Modern search radars, such as those carried by Coast Guard helicopters, can detect small targets. The corner reflector within the vessel would provide a consistent radar target which could be easily discriminated from sea clutter and floating debris, which display erratic reflective characteristics due to their shape and composition.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims.

DETAILED DESCRIPTION OF THE INVENTION

Figure 1:
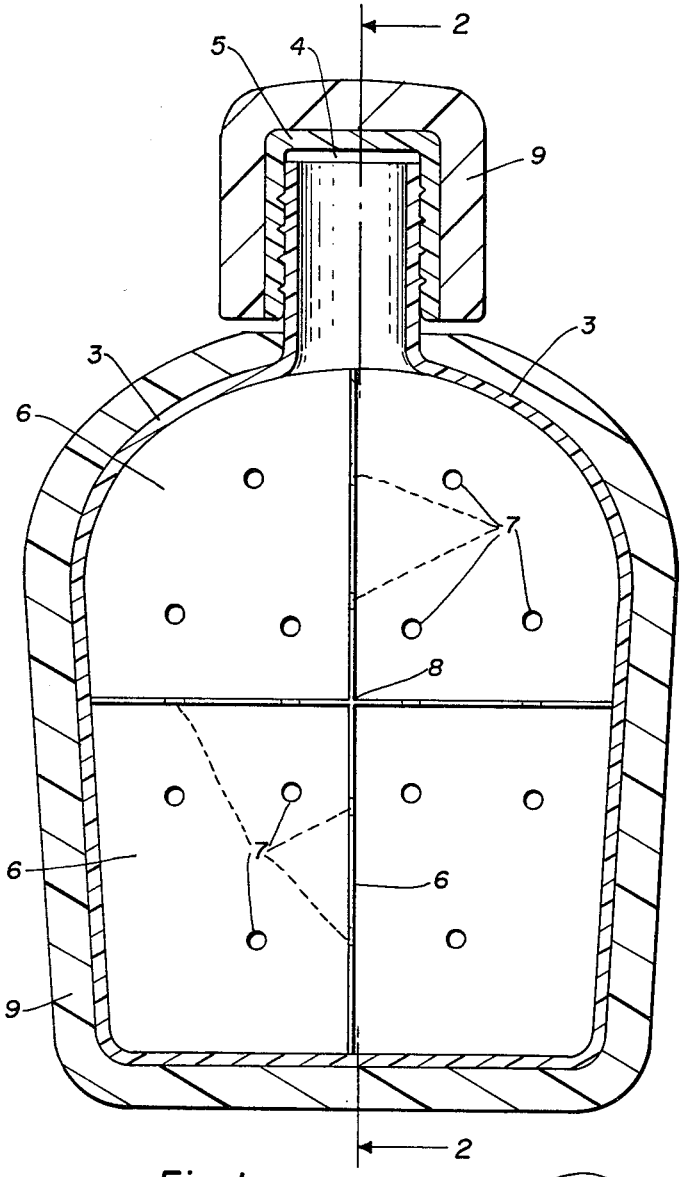
FIG. 1 is a front elevation view in cross-section taken substantially along the plane of line 1—1 of FIG. 2.
Figure 2:
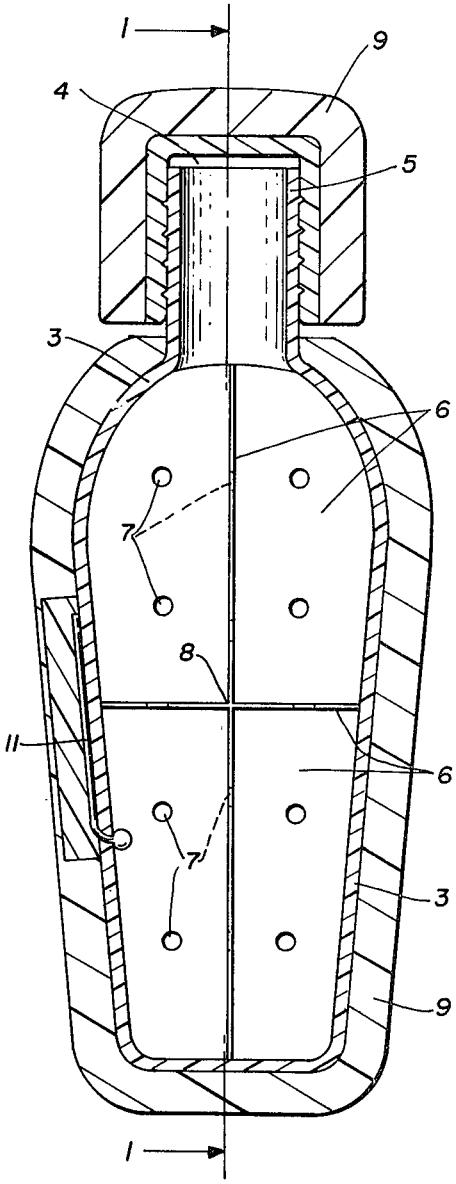
FIG. 2 is a side elevation view in cross-section taken substantially along the plane of line 2—2 of FIG. 1.
Figure 3:
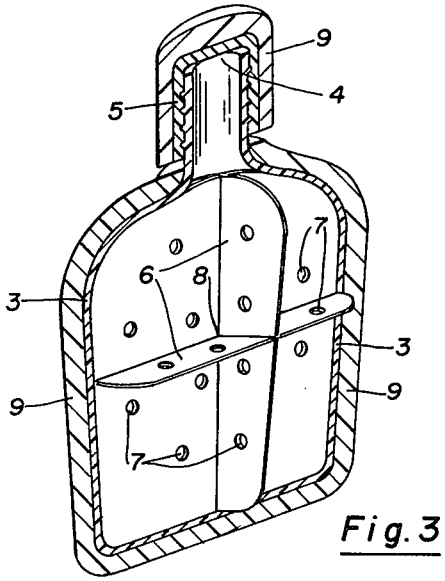
FIG. 3 is a top perspective view in reduced scale, partially cut away.

The multi-purpose survival canteen of the present invention comprises, briefly, a substantially microwave-transparent vessel 3 for holding liquids having a sealable mouth 4. In the preferred embodiment, the mouth is threaded and covered with a screw-on cap 5. The vessel 3 has internal microwave-reflective baffles 6 which divide the vessel into chambers. Openings 7 are provided between the chambers to allow damped fluid flow therebetween. The baffles 6 are positioned to define at least one corner reflector 8 where three baffles meet at perpendicular angles.

In order to improve the thermal insulating efficiency and flotation of the canteen, the vessel 3 is, in the preferred embodiment, surrounded by microwave-transparent thermal insulating material 9 which has density and volume sufficient to maintain the vessel buoyant when filled with liquid. The cap 5 is similarly surrounded with foam 9 in the preferred embodiment.

The openings 7 in the baffles 6 are made sufficient in size and number to dampen the sloshing of liquid between chambers, while allowing liquid to be drained through the mouth 4 at a rate suitable for drinking. In the preferred embodiment, an externally viewable thermometer 11 is provided which measures and displays the temperature of the fluid contained within the vessel 3. The baffles 6 are arranged in the vessel so as to define eight corner reflectors. Baffle materials such as aluminum and stainless steel are good reflectors of microwave energy and are highly resistant to corrosion which might contaminate the contents of the vessel. Insofar as the composition of the vessel 3 is concerned, fiberglass, resin, and various polyethylene-type plastics have been found to provide suitable structural integrity and microwave transparency.

What is claimed is:

1. A survival canteen comprising:

a substantially microwave transparent vessel for holding liquid, having a sealable mouth;

said vessel having internal microwave reflective baffles dividing the vessel into chambers and openings between the chambers to allow damped fluid flow therebetween; and said baffles positioned to define at least one corner reflector.

2. The canteen of claim 1, said vessel surrounded by microwave transparent thermal insulating material.

3. The canteen of claim 2, said material having density and volume sufficient to maintain the vessel buoyant when filled with liquid.

4. The canteen of claim 1, said openings being sufficient in size and number to dampen sloshing of liquid between chambers while allowing liquid to be drained through said mouth at a rate suitable for drinking.

5. The canteen of claim 1, and an externally viewable thermometer adapted to measure and display the temperature of the fluid within said vessel.

6. The canteen of claim 1, said baffles having stainless steel composition and defining eight corner reflectors.

7. The canteen of claim 1, said baffles having aluminum composition and defining eight corner reflectors.

* * * * *